US009567121B2

(12) United States Patent
Aya

(10) Patent No.: US 9,567,121 B2
(45) Date of Patent: Feb. 14, 2017

(54) BUNDLED OBJECT, BUNDLING METHOD, AND BUNDLING APPARATUS

(71) Applicant: FUJIFILM Corporation, Tokyo (JP)

(72) Inventor: Shinichi Aya, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 109 days.

(21) Appl. No.: 14/300,646

(22) Filed: Jun. 10, 2014

(65) Prior Publication Data

US 2014/0360904 A1 Dec. 11, 2014

(30) Foreign Application Priority Data

Jun. 11, 2013 (JP) ..... 2013-122639
Jun. 4, 2014 (JP) ..... 2014-115485

(51) Int. Cl.

*B65D 71/02* (2006.01)
*B65B 13/32* (2006.01)
*B65B 13/04* (2006.01)
*B65B 27/08* (2006.01)

(52) U.S. Cl.

CPC ..... *B65B 13/32* (2013.01); *B65B 13/04* (2013.01); *B65B 27/083* (2013.01)

(58) Field of Classification Search

CPC ..... B65B 13/04; B65B 27/038; B65B 13/32; B65B 27/08; B65B 27/083; B65D 71/02; B65D 75/5855

USPC ..... 206/449, 442, 495, 770, 340, 494, 422; 294/156; 53/540, 399

See application file for complete search history.

(56) References Cited

U.S. PATENT DOCUMENTS 4,444,315 A * 4/1984 Gaskill, Jr. ..... B41L 1/32 206/449
4,830,186 A 5/1989 George et al.
5,501,387 A * 3/1996 Yoshie ..... B27F 7/38 206/340
5,676,299 A * 10/1997 Yoshie ..... B65D 5/00 227/120
5,996,991 A * 12/1999 Dirx ..... B41J 13/00 271/149
6,044,975 A * 4/2000 Dirx ..... B41J 13/00 206/451

(Continued)

FOREIGN PATENT DOCUMENTS

JP 53-75368 U 6/1978
JP 62-4088 A 1/1987

(Continued)

*Primary Examiner* — Chun Cheung
(74) *Attorney, Agent, or Firm* — Birch, Stewart, Kolasch & Birch, LLP

(57) ABSTRACT

A bundled object is obtained in which a plurality of overlapped articles is sufficiently strongly bundled and it is also easy to release the bundling. A bundled object 1 is configured to include a body-to-be-bundled 3 which is made by overlapping a plurality of articles 2 and has four marginal portions 3*a* each extending a direction orthogonal to an overlapping direction, and a strip-shaped plastic tape 4 which bundles the body-to-be-bundled 3 by winding around the body-to-be-bundled 3 once so as to pass over the four marginal portions 3*a*. Then, both end portions 4*a* and 4*b* other than a winding portion of the plastic tape 4 are overlapped on each other at a position away from the body-to-be-bundled 3 and close to one marginal portion 3*a*, and the overlapped tape both end portions 4*a* and 4*b* are welded to each other at a plurality of welded portions H.

22 Claims, 8 Drawing Sheets

(56) References Cited

U.S. PATENT DOCUMENTS 8,813,953 B2 * 8/2014 Wegener ..... B65D 71/14
206/214

FOREIGN PATENT DOCUMENTS

| | | | |
|---|---|---|---|
| JP | 2-242758 | A | 9/1990 |
| JP | 7-61418 | A | 3/1995 |
| JP | 2000-153807 | A | 6/2000 |
| JP | 2002-211633 | A | 7/2002 |

* cited by examiner

BUNDLED OBJECT, BUNDLING METHOD, AND BUNDLING APPARATUS

CROSS REFERENCE TO RELATED APPLICATIONS

This application claims priority under 35 U.S.C §119 to Japanese Patent Application No. 2013-122639, filed Jun. 11, 2013 and Japanese Patent Application No. 2014-115485, filed Jun. 4, 2014. Each of the above applications are hereby expressly incorporated by reference, in its entirety, into the present application.

BACKGROUND OF THE INVENTION

1. Field of the Invention

The present invention relates to a bundled object that is made by bundling a body-to-be-bundled which is made by overlapping a plurality of articles, with a plastic tape.

Further, the present invention relates to a bundling method and a bundling apparatus for manufacturing the bundled object as described above.

2. Description of the Related Art

In the past, in order to transport, store, or the like, articles having a relatively flat shape, overlapping a plurality of articles and then bundling the articles with a tape or a string has been widely performed. In a bundled object which is formed in this way, for example, in a case where the bundled object is discarded as it is, a case where consideration is required for releasing the bundling is less common. However, under other situations, it is sometimes required that the bundling be easily released.

As a concrete situation where there is a demand as described above, a case where an article is an analysis element (generally referred to as a slide, a cartridge, a card, a medium, or the like) that is used for some sort of analysis or inspection before the articles are loaded into an analyzer or the like, the articles are handled in the form of a bundled object in which a plurality of articles are put together and if the bundled object is loaded into the analyzer or the like, the articles are made to be able to be used one by one by cutting a tape or the like for the bundling, or the like can be given. In such a case, it is also required that the cut tape, string, or the like can be easily removed from the periphery of the plurality of articles.

As a bundled object made such that work to cut a tape, a string, or the like for bundling and then remove it from the periphery of a plurality of articles, as described above, is easily performed, a bundled object described in JP1987-4088A (JP-S62-4088A) or JP2002-211633A is publicly known.

The bundled object described in JP1987-4088A (JP-S62-4088A) is a bundled object made by forming a stack by overlapping copy sheets (copying paper) as articles, winding and bundling the stack by hard paperboard and a flexible packaging band, and then joining one end and the other end of the packaging band so as to be able to be torn off on the side surface of the stack.

Further, the bundled object described in JP2002-211633A is a bundled object made by forming a laminated body by stacking up prepackaged spoons as articles in multiple stages, winding and bundling the laminated body by a band film, and welding a rear end portion and a leading end portion of the band film so as to be able to be torn off on the side surface of the laminated body.

SUMMARY OF THE INVENTION

In the bundled object described in JP1987-4088A (JP-S62-4088A), one end and the other end of the packaging band are joined to each other so as to be able to be easily torn off, and thus releasing the bundling is simple, whereas a possibility that during transport or the like, the joining may come off, whereby the bundling may be loosened is recognized. Further, also in the bundled object described in JP2002-211633A, releasing the bundling is simple, whereas it is difficult to say that a plurality of articles can be sufficiently strongly bundled.

The present invention has been made in view of the above-described circumstances and has an object to provide a bundled object in which a plurality of overlapped articles is sufficiently strongly bundled and on the other hand, it is also easy to release the bundling.

Further, the present invention has an object to provide a bundling method and a bundling apparatus in which it is possible to manufacture the bundled object as described above.

According to an aspect of the present invention, there is provided a bundled object including:

- a body-to-be-bundled which is made by overlapping a plurality of articles and has four marginal portions each extending in a direction orthogonal to an overlapping direction; and
- a strip-shaped plastic tape which bundles the body-to-be-bundled by winding around the body-to-be-bundled once so as to pass over the four marginal portions,
- wherein the bundled object has superimposed portions in which both ends of the plastic tape are overlapped on each other from a position of one marginal portion among the four marginal portions in a state of being away from the body-to-be-bundled, and
- the superimposed portions are welded to each other at a plurality of places arranged at intervals from each other in a tape width direction, at end portions on the body-to-be-bundled side.

In addition, in the bundled object according to the present invention having the above-described configuration,

- it is preferable that the shape of one welded portion of the plastic tape be a rectangular shape, one side of which is parallel to a width direction of the plastic tape, and
- that a ratio of an area of the welded portion to the total area of the welded portion and a non-welded portion which is located between two welded portions be in a range of 20% to 70%, and more preferably, a range of 30% to 50%.

Further, it is preferable that the plastic tape configuring the bundled object according to the present invention be a tape made of at least one of polyethylene and polypropylene.

On the other hand, according to another aspect of the present invention, there is provided a bundling method for manufacturing the bundled object according to the present invention described above, including:

- storing the plastic tape which has been elongated in storage unit;
- drawing a leading end of the plastic tape in a longitudinal direction;
- putting the drawn plastic tape over a side plate having a flat upper surface, and an article placement table;
- stacking up and placing a plurality of articles on the article placement table with the plastic tape put over the article placement table interposed therebetween, thereby forming a body-to-be-bundled composed of the plurality of articles;
- moving the plastic tape on the leading end side so as to be separated upward from the article placement table and be returned farther to the storage unit side than the side plate, thereby bringing an upper end of the body-to-be-bundled moving upward, into contact with up-and-down position defining unit, and also bringing a side surface of the body-to-be-bundled moving to the storage unit side, into contact with the side plate;

making a force to tighten the body-to-be-bundled act on the plastic tape;

welding two plastic tapes to each other on the upper surface of the side plate in a state where the force acts on the plastic tape and the two plastic tapes are placed on the upper surface; and thereafter, cutting the plastic tape between a portion in which the welding is made and the storage unit.

In the bundling method according to the present invention, more preferably, in the step of drawing a leading end of the plastic tape in a longitudinal direction, the plastic tape is drawn in the longitudinal direction with one end as a leading end in a drawing direction, in the step of putting the drawn plastic tape over a side plate having a flat upper surface, and an article placement table, the article placement table is located on the side opposite to the storage unit with respect to the side plate and is at a position lower than the upper surface, in the step of stacking up and placing a plurality of articles on the article placement table with the plastic tape put over the article placement table interposed therebetween, thereby forming a body-to-be-bundled composed of the plurality of articles, the plurality of articles are placed on the article placement table with a portion farther on the storage unit side than the leading end of the plastic tape interposed therebetween, in the step of moving the plastic tape on the leading end side so as to be separated upward from the article placement table and be returned farther to the storage unit side than the side plate, the plastic tape is fixed farther on the storage unit side than a place on which the body-to-be-bundled is placed, and the plastic tape further on the leading end side than the place on which the body-to-be-bundled is placed is moved so as to be separated upward from the article placement table and be returned farther to the storage unit side than the side plate.

In addition, in the bundling method according to the present invention having the above-described configuration, it is preferable that tensile stress be made to act on the plastic tape in order to tighten the body-to-be-bundled and that a magnitude of the stress be set to be in a range of 40% to 99%, and more preferably, a range of 50% to 80% of stress in which the plastic tape starts plastic deformation.

Further, in the bundling method according to the present invention having the above-described configuration, it is preferable that the welding be performed by using a heat block in which convex portions for heating in which a tip surface coming into contact with the plastic tape in order to weld the plastic tapes to each other has a rectangular shape and one side of the rectangular shape is set to be parallel to a width direction of the plastic tape are disposed in a plurality at intervals from each other in the width direction of the plastic tape.

In a case of doing so, it is preferable that a heat block in which an area ratio of the convex portion for heating against the total area of the convex portion for heating and one space between the convex portion for heating wherein the space adjacent to the convex portion for heating, is in a range of 20% to 70%, and more preferably, a range of 30% to 50% be used for the heat block.

Further, in the bundling method according to the present invention having the above-described configuration, it is preferable that in a step of bringing an upper end of the body-to-be-bundled moving upward, into contact with the up-and-down position defining unit, the upper end of the body-to-be-bundled be brought into contact with the up-and-down position defining unit at a position on the same plane as the upper surface of the side plate.

Further, according to still another aspect of the present invention, there is provided a bundling apparatus for manufacturing the bundled object according to the present invention described above, including:

a storage unit for storing a plastic tape which has been elongated;

a tape drawing unit for drawing a leading end of the plastic tape in a longitudinal direction;

an article set holder having a side plate having a flat upper surface, and an article placement table which is located on the side opposite to the storage unit with respect to the side plate;

a tape putting-over unit for putting the drawn plastic tape over the upper surface of the side plate and the article placement table;

a body-to-be-bundled supply unit for stacking up and placing a plurality of articles on the article placement table, thereby forming a body-to-be-bundled composed of the plurality of articles;

an up-and-down position defining unit disposed above the body-to-be-bundled formed on the article placement table, at a distance from the body-to-be-bundled;

a tape moving unit for moving the plastic tape on the leading end side so as to be separated upward from the article placement table and be returned farther to the storage unit side than the side plate, thereby bringing an upper end of the body-to-be-bundled into contact with the up-and-down position defining unit and also bringing a side surface of the body-to-be-bundled into contact with the side plate;

a tape tightening unit for making a force to tighten the body-to-be-bundled act on the plastic tape;

a welding unit for welding two plastic tapes to each other on the upper surface of the side plate in a state where the force acts on the plastic tape and the two plastic tapes are placed on the upper surface; and a tape cutting unit for cutting the plastic tape between a portion in which the welding is made and the storage unit.

The bundling apparatus according to the present invention more preferably further include a tape fixing section which fixes the plastic tape farther on the storage unit side than a place on which the body-to-be-bundled is placed, wherein the tape drawing section draws the plastic tape in the longitudinal direction with one end of the plastic tape as a leading end in a drawing direction, the article placement table is at a position lower than the upper surface of the side plate, and the body-to-be-bundled supply section stacks up and places a plurality of articles on the article placement table with a portion further on the storage unit side than the leading end of the plastic tape interposed therebetween the tape moving unit moves the plastic tape farther on the leading end side than the place on which the body-to-be-bundled is placed, so as to be separated upward from the article placement table and be returned farther to the storage unit side than the side plate, thereby bringing an upper end of the body-to-be-bundled moving upward, into contact with the up-and-down position defining unit, and also bringing a side surface of the body-to-be-bundled moving to the storage unit side, into contact with the side plate.

In addition, it is preferable that the tape tightening unit make tensile stress act on the plastic tape in order to tighten the body-to-be-bundled and that the stress be set to be in a range of 40% to 99%, and more preferably, a range of 50% to 80% of stress in which the plastic tape starts plastic deformation.

Further, it is preferable that the welding unit be a heat block in which convex portions for heating in which a tip surface coming into contact with the plastic tape has a rectangular shape and one side of the rectangular shape is set to be parallel to a width direction of the plastic tape are disposed in a plurality at intervals from each other in the width direction of the plastic tape.

Then, it is preferable that such a heat block be a heat block in which an area ratio of the convex portion for heating against the total area of the convex portion for heating, and one space between the convex portion for heating wherein the space is adjacent to the convex portion for heating, is in a range of 20% to 70%, and more preferably a range of 30% to 50%.

Further, it is preferable that the up-and-down position defining unit have a lower surface which comes into contact with the body-to-be-bundled and that when the tape moving unit brings the upper end of the body-to-be-bundled into contact with the up-and-down position defining unit, the lower surface of the up-and-down position defining unit be located on the same plane as the upper surface of the side plate.

In the bundled object according to the present invention, both end portions of the plastic tape are in a state of extending farther to the outside in a tape length direction than the welded portions, and thus it is possible to release the bundling by tearing the plastic tape at the plurality of welded portions and non-welded portions adjacent thereto by pulling both end portions.

Then, in the bundled object according to the present invention, both end portions other than a portion of the plastic tape winding around the body-to-be-bundled are overlapped on each other at a position away from the body-to-be-bundled and close to one of the four marginal portions of the body-to-be-bundled, and at the overlapped portions, both end portions of the plastic tape are welded to each other at a plurality of places arranged at intervals from each other in the tape wide direction, and therefore, at the time of the welding of the plastic tapes, the portion of the plastic tape wound around the body-to-be-bundled is prevented from being heated. Therefore, since the bundling is prevented from being weakened due to stretching of the plastic tape of the portion by heating, the bundled object according to the present invention can be strongly bundled.

Further, in the bundled object according to the present invention, both end portions of the plastic tape are welded to each other at a position close to one marginal portion of the body-to-be-bundled, and thus an effect is exhibited in that it becomes possible to easily release the bundling by making a force to tear the welded portions and the non-welded portions adjacent thereto of the plastic tape efficiently act on the welded portions and the non-welded portions when releasing the bundling, as will be described in detail with reference to an embodiment later.

This effect is obtained by using the marginal portion of the body-to-be-bundled biting the plastic tape, as will be described in detail later, and it becomes unnecessary to set the welding strength (joint strength) of the welded portion to be particularly low for easier release of the bundling. Accordingly, in the bundled object according to the present invention, it is possible to set the welding strength of the welded portion to be sufficiently high, and thus also in this regard, the bundled object according to the present invention can be strongly bundled.

In addition, in the bundled object according to the present invention, it is possible to make tensile stress act on the plastic tape in order to tighten the body-to-be-bundled and to set the welding strength of the welded portion to be sufficiently high, and thus it also becomes possible to prevent the bundling from being released during the transport or the like of the bundled object.

On the other hand, as described above, the bundling method according to the present invention, it becomes possible to manufacture the bundled object according to the present invention described above.

Further, as described above, the bundling apparatus according to the present invention, it becomes possible to manufacture the bundled object according to the present invention described above.

DESCRIPTION OF THE PREFERRED EMBODIMENTS

Figure 1:
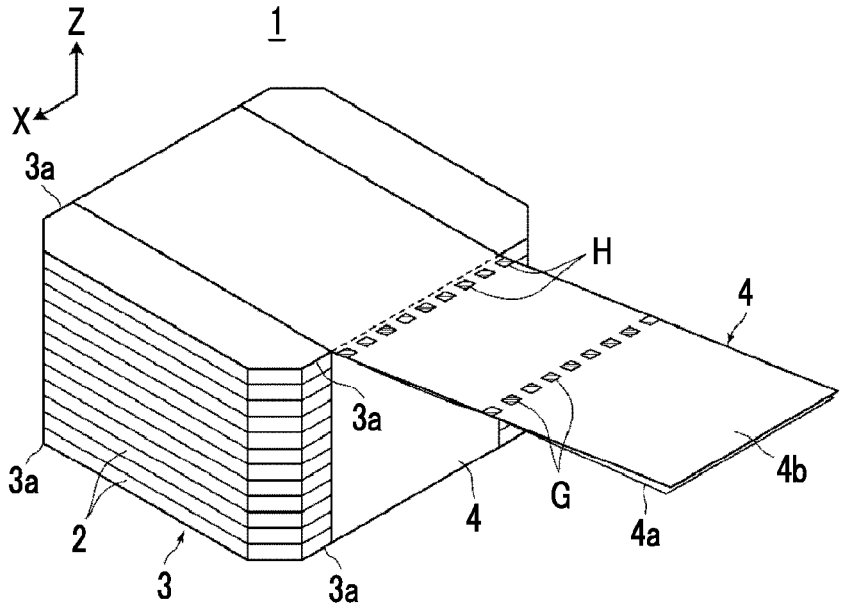
FIG. 1 is a perspective view showing a bundled object according to an embodiment of the present invention.

Hereinafter, embodiments of the present invention will be described in detail with reference to the drawings. FIG. 1 shows the perspective shape of a bundled object 1 according to an embodiment of the present invention. The bundled object 1 is an object which is made by bundling a laminated body 3 as a body-to-be-bundled which is made by overlapping a plurality of articles 2, with a plastic tape 4.

In this embodiment, the article 2 is a slide for biochemical analysis (hereinafter referred to simply as a slide 2) as an example. The slide 2 of this example is an object made by supporting a reagent or the like for specimen analysis on, for example, a thin and substantially rectangular-shaped plastic substrate. Then, the slides 2 are made so as to be loaded into an analyzer (not shown) in a state where a plurality of slides 2 are overlapped, and for this reason, the slides 2 are handled in the state of the laminated body 3 in which a plurality of slides 2 are put together. If the laminated body 3 is configured by laminating a plurality of slides 2 each made of a substrate having the above-described shape, the laminated body 3 has a substantially rectangular parallelepiped shape having four marginal portions 3*a*. Each of the marginal portions 3*a* is parallel to a direction (a direction of an arrow X) orthogonal to a direction (a direction of an arrow Z) in which the slides 2 are overlapped.

On the other hand, the plastic tape 4 for bundling is a tape obtained by cutting a thin sheet material made of, for example, high-density polyethylene, into a tape shape having a predetermined width. If a heating member is pressed in a state where two plastic tapes 4 are overlapped, as will be described later, heated and pressed portions are welded to each other. In addition, an appropriate temperature of the heating member for welding will be described in detail later.

The plastic tape 4 bundles the laminated body 3 by winding around the laminated body 3 once so as to pass over the four marginal portions 3*a* of the laminated body 3. Describing in more detail, the plastic tape 4 is made longer than a length corresponding to one round of the laminated body 3 as a whole, and thus, in addition to a portion winding around the laminated body 3, both end portions 4*a* and 4*b* having some degree of length are left as overlapped portions. That is, both ends of the plastic tape are in a state of being away from the laminated body 3 that is a body-to-be-bundled. Then, both end portions 4*a* and 4*b* of the tape are away from the laminated body 3 and are overlapped on each other from the position of one marginal portion 3*a*, and the overlapped portions (superimposed portions) are welded to each other at a position close to one marginal portion 3*a*, that is, at end portions on the laminated body 3 side. In FIG. 1, portions in which the welding is made are schematically hatched and indicated by H. As shown in the drawing, the welded portions H are provided at a plurality of places at intervals (non-welded portions) from each other in a width direction of the plastic tape 4.

Both end portions 4*a* and 4*b* of the plastic tape 4 extend as pull tape portions for pulling (described later) farther to the outside in a tape length direction (the side away from the laminated body 3) than the welded portions H. In addition, in this example, a plurality of welded portions G similar to the welded portions H are formed farther to the outside in the tape length direction than the welded portions H. The welded portions G are formed in order to put both end portions 4*a* and 4*b* of the plastic tape 4 together and easily hold the portions and may be omitted as appropriate. Further, both end portions 4*a* and 4*b* of the plastic tape 4 may be cut at a position just outside of the welded portions in addition to being left slightly long outside the welded portions as shown in the drawing.

Figure 2:
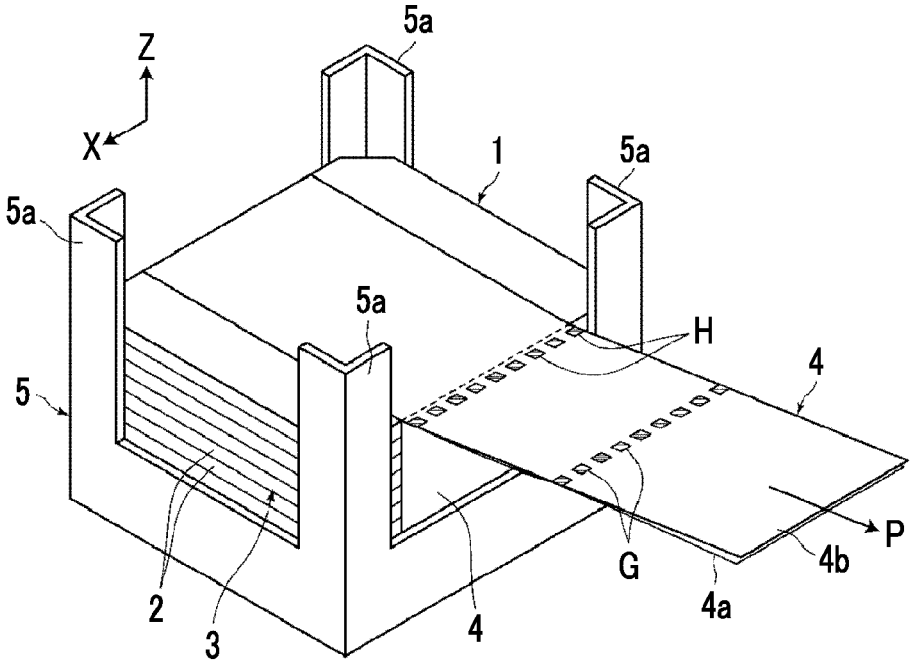
FIG. 2 is a perspective view showing an example of a holder which accommodates the bundled object of FIG. 1.

When releasing the bundling of the bundled object 1 formed as described above, the laminated body 3 is retained in, for example, a given holder 5 or the like, as shown in FIG. 2. In addition, in FIG. 2, elements equivalent to those in FIG. 1 are denoted by the same reference numerals and description thereof is omitted unless it is particularly necessary (hereinafter, the same). The holder 5 shown here has four vertical members 5*a* having a substantially L-shaped cross-section, which face four corner portions of the bundled object 1 with some gap therebetween, and is formed approximately in a bottomed box shape, and both end portions 4*a* and 4*b* of the plastic tape 4 are made so as to be able to pass between two vertical members 5*a*. That is, the gap between the two vertical members 5*a* is larger than the width of the plastic tape 4. In addition, at this time, the portion wound around the bundled object 1, of the plastic tape 4, is in a state of not being strongly pressed by the holder 5 from the side.

Then, from this state, both end portions 4*a* and 4*b* as the pull tape portions of the plastic tape 4 are gripped by the fingers of a worker and pulled in a direction of an arrow P with a force strong to some extent. In addition, the pulling direction is, as an example, a direction approximately parallel to the upper surface of the laminated body 3 (that is, the upper surface of the slide 2 stacked at the top), a direction approximately orthogonal to the upper surface, or a direction deviated by an angle of the extent less than or equal to ±30° with respect to these directions.

Figure 3:
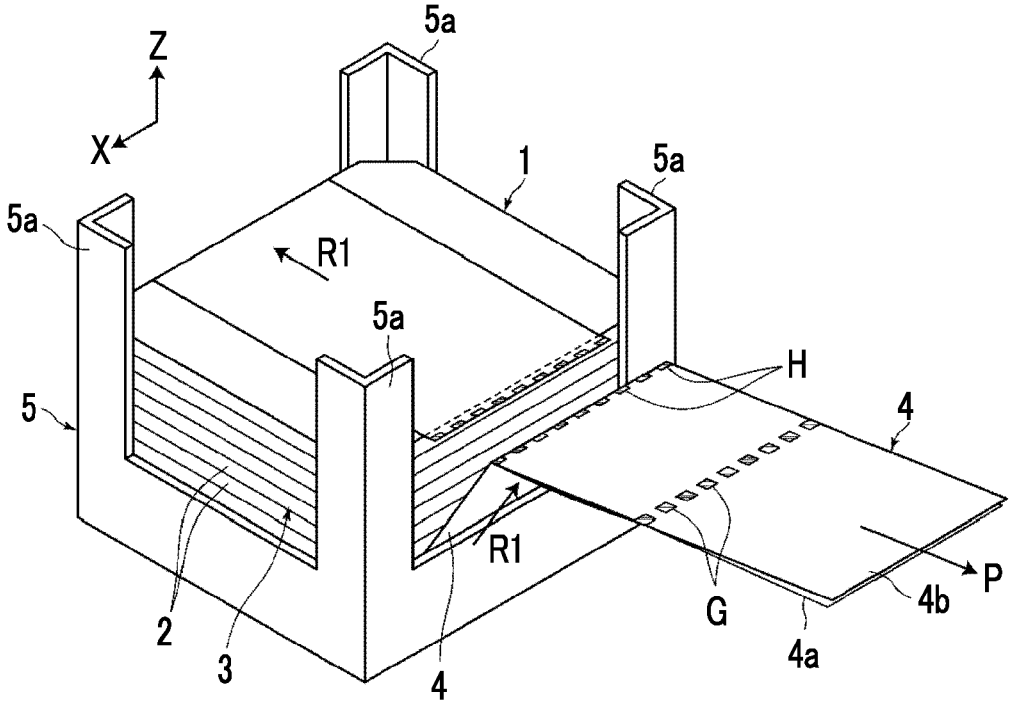
FIG. 3 is a perspective view showing an example of a state where the bundling of the bundled object of FIG. 1 is released.

If both end portions 4*a* and 4*b* of the plastic tape 4 are pulled in the direction approximately parallel to the upper surface of the laminated body 3, as shown in FIG. 3, the plastic tape 4 on one side (in this example, the upper side) of the two overlapped plastic tapes is torn at the plurality of welded portions H and the non-welded portions adjacent thereto of the plastic tape 4 and the tearing proceeds over the entire width of the tape, whereby the plastic tape 4 is cut. Then, if both end portions 4*a* and 4*b* of the plastic tape 4 are pulled as they are, the cut end portion of the plastic tape 4 moves in a direction shown by an arrow R1 in the drawing and is finally extracted from the periphery of the laminated body 3. When in such a state, the laminated body 3 which is present in the inside of the holder 5 is released from the bundling with the plastic tape 4 and enters a state where the plurality of slides 2 are simply stacked up. Therefore, if the holder 5 is set in an analyzer as it is, it is possible to load the plurality of slides 2 into the analyzer in a usable state.

Figure 4:
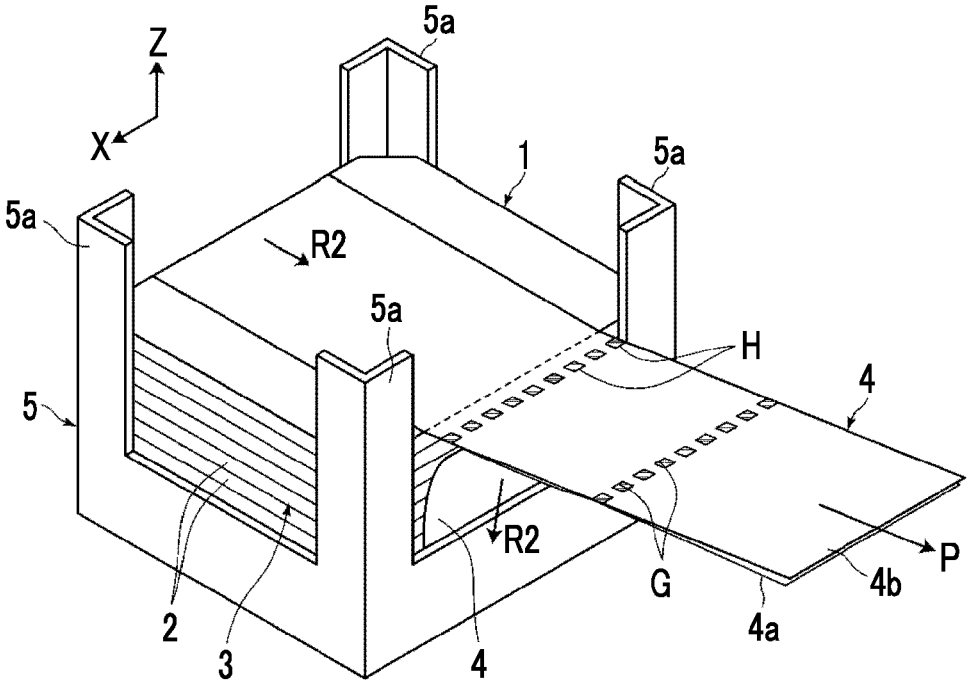
FIG. 4 is a perspective view showing another example of a state where the bundling of the bundled object of FIG. 1 is released.

Note that, the direction of pulling both end portions 4*a* and 4*b* of the plastic tape 4 may be a direction that is approximately orthogonal to the upper surface of the laminated body 3 and is an upward direction in the plane of paper, or a direction deviated by an angle to the extent less than or equal to ±30° with respect to the directions. In this case, it is necessary to restrict movement by some means such that the laminated body does not move in the upward direction in the plane of paper. For example, a weight may be placed on the laminated body, or the laminated body may be pressed down by the human hand. In such a case, a cutting state of the plastic tape 4 generally becomes a state as shown in FIG. 4. That is, in this case, the plastic tape 4 on the lower side of the two overlapped tapes is cut. When in such a state, a moving direction of the cut end portion of the plastic tape 4 becomes a direction shown by an arrow R2 in the drawing, that is, the opposite direction to that in the case shown in FIG. 2. However, even in the state of FIG. 3 or even in the state of FIG. 4, there is no change in an operation in which by continuing to pull both end portions 4*a* and 4*b* of the plastic tape 4, the bundling of the laminated body 3 is released and the plastic tape 4 is then extracted from the periphery of the laminated body 3, and therefore, a problem does not occur particularly.

Figure 5:
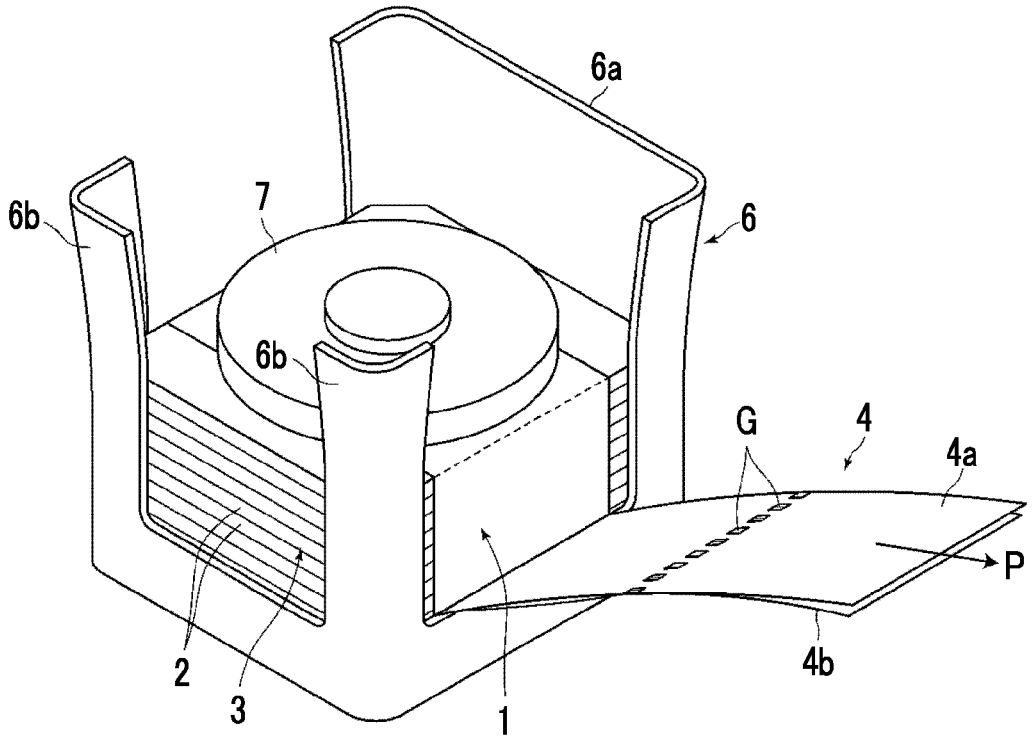
FIG. 5 is a perspective view showing another example of the holder which accommodates the bundled object of FIG. 1.

Here, in FIG. 5, another means for carrying out the same action as in the holder 5 described above is shown. A holder 6 shown here has a single side plate 6*a* and two vertical members 6*b* and is formed approximately in a bottomed box shape. In the side plate 6*a*, two end portions are bent in a direction of the bundled object 1 such that the side plate 6*a* faces one side surface and two corners of the four corners of the bundled object 1 with some gap therebetween. On the other hand, the vertical members 6*b* are formed to have a substantially L-shaped cross-section so as to face the remaining two corners of the four corners of the bundled object 1 with some gap therebetween. Both end portions 4*a* and 4*b* of the plastic tape 4 are made so as to be able to pass through between one vertical member 6*b* and the side plate 6*a*. That is, the gap between one vertical member 6*b* and the side plate 6*a* is larger than the width of the plastic tape 4.

In the holder 6, the bundled object 1 is retained upside down compared to the case of FIG. 2. Then, a weight (dead weight) 7 to lightly press down the laminated body 3 from above the plastic tape 4 is placed on the retained bundled object 1. Also in this case, by pulling both end portions 4*a* and 4*b* of the plastic tape 4 in the direction of the arrow P, the plastic tape 4 is torn at the plurality of welded portions H (not shown) and the non-welded portions adjacent thereto, in the same way as described above, and the plastic tape 4 releasing the bundling is then extracted.

Figure 6:
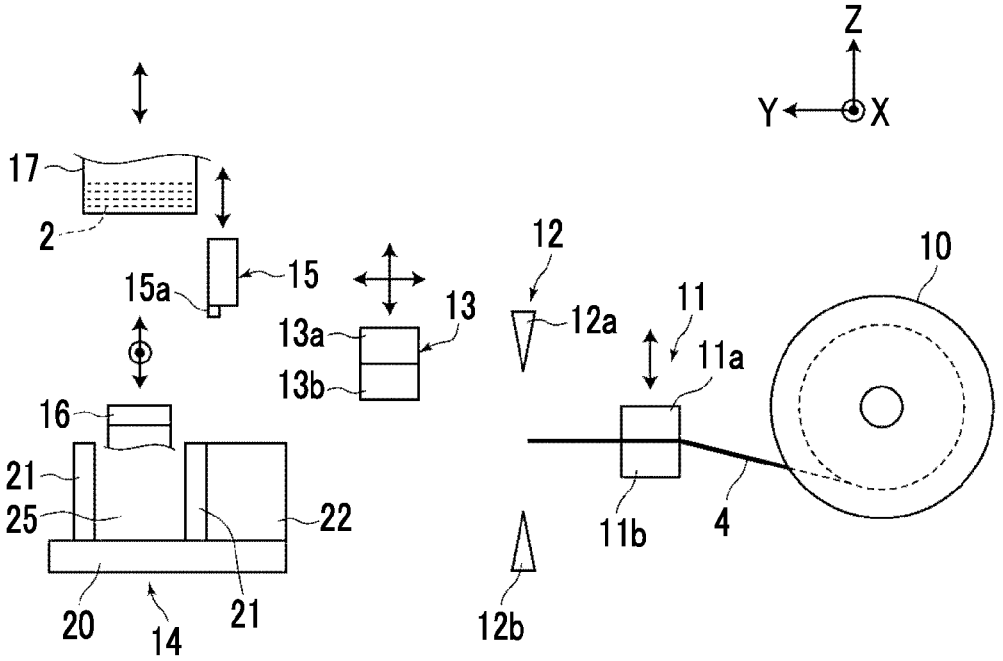
FIG. 6 is a schematic diagram showing the basic configuration of a bundling apparatus according to an embodiment of the present invention.

Next, a bundling method for manufacturing the bundled object 1 described above will be described. FIG. 6 shows a schematic configuration of a bundling apparatus according to an embodiment of the present invention. In addition, in this drawing, an X direction, a Y direction, and a Z direction orthogonal to each other are defined as shown in the drawing. Here, the X direction and the Z direction correspond to those in FIGS. 1 to 4. Then, with regard to an element which is each element that will be described later and moves in at least one direction of the X, Y, and Z directions, a moving direction thereof is shown by an arrow denoted above each element. Further, in the following, the movement in a +Z direction of a certain element is sometimes referred to as an "ascent" and the movement in a −Z direction is sometimes referred to as a "descent".

As shown in the drawing, the bundling apparatus has a tape supply roll 10 which is a storage unit for winding and storing the plastic tape 4 which has been elongated, a delivery clamp 11 which grips a leading end portion of the plastic tape 4 drawn from the tape supply roll 10, by a pair of upper and lower clamp pieces 11*a* and 11*b*, a tape cutter 12 which is configured by an upper blade 12*a* and a lower blade 12*b*, and a transport clamp 13 which grips the leading end portion of the plastic tape 4 by a pair of upper and lower clamp pieces 13*a* and 13*b*. In addition, in FIG. 6, the width direction of the plastic tape 4 is the X direction.

The clamp pieces 11*a* and 11*b* of the delivery clamp 11 are made such that each of the clamp pieces 11*a* and 11*b* can move in an up-and-down direction, that is, the ±Z direction, and move in a direction approaching each other, thereby entering a state of coming into contact with each other with the plastic tape 4 interposed therebetween, and thus gripping the leading end portion of the plastic tape 4, and move in a direction away from each other from there, thereby releasing the leading end portion of the plastic tape 4. The upper blade 12*a* and the lower blade 12*b* of the tape cutter 12 are also made such that each the upper blade 12*a* and the lower blade 12*b* can move in the up-and-down direction, that is, the ±Z direction, and move in a direction approaching each other, thereby sandwiching the leading end portion of the plastic tape 4 therebetween from the top and the bottom and then cutting the leading end portion of the plastic tape 4.

The clamp pieces 13*a* and 13*b* of the transport clamp 13 are also made such that each of the clamp pieces 13*a* and 13*b* can move in the up-and-down direction, that is, the ±Z direction, and move in a direction approaching each other, thereby entering a state of coming into contact with each other with the plastic tape 4 interposed therebetween, and thus gripping the leading end portion of the plastic tape 4, and move in a direction away from each other from there, thereby releasing the leading end portion of the plastic tape 4. Then, the transport clamp 13 is made so as to be able to move in the ±Z direction and a ±Y direction in a state of gripping the leading end portion of the plastic tape 4 and configures a tape drawing unit, a tape putting-over unit, a tape moving unit, and a tape tightening unit in the bundling apparatus according to the present invention.

The bundling apparatus further has a slide set holder 14, a heat block 15 as a welding unit made so as to be able to move in the ±Z direction, a set guide 16 as an up-and-down position defining unit made so as to be able to move in the ±Z direction and a ±X direction, and a slide supply unit 17 as a body-to-be-bundled supply unit made so as to be able to move in the ±Z direction.

As shown in FIG. 6, the slide set holder 14 is configured to include a slide placement table 20 extending in a horizontal direction, four slide holding frames 21 which are stood up vertically upward from the slide placement table 20 and each have the same shape as the vertical member 5*a*, and a single holder side plate 22 likewise stood up vertically upward from the slide placement table 20. The four slide holding frames 21 define a slide placement section 25 that is a space for overlapping the plurality of slides 2, therebetween.

The heat block 15 has, at a bottom portion thereof, a plurality of convex portions 15*a* which are arranged in a row in the X direction at intervals from each other (refer to FIGS. 15A to 15D which will be described later). The convex portions 15*a* are made of metal having high thermal conductivity and are made so as to be heated by, for example, electric heating unit (not shown) or the like at a predetermined temperature. If the convex portions 15*a* heated in this way are pressed against two plastic tapes 4 overlapped as will be described later, both the plastic tapes 4 are welded to each other at heated and pressed portions thereof.

Further, it is preferable that the heat block 15 be provided with the comb tooth-like convex portions for heating 15*a* each having a rectangular tip surface (refer to FIGS. 15A to 15D), and a space between the convex portion and the convex portion adjacent thereto (a space which is located between the two convex portions for heating 15*a* adjacent to each other at a distance). It is preferable that the rectangular tip surface be either a rectangular tip surface or a square tip surface, and the rectangular tip surface is more preferable. Here, the rectangular shape means a rectangle or a shape similar to a rectangle, and a shape such as a rectangle having four rounded corners is also included therein. Further, the area of the space between the convex portions is the area of a plane which is located between the two convex portions 15*a*, and refers to the area of a rectangle in which a distance between the two convex portions 15*a* in a convex portion arrangement direction is set to be the length of one side and the length of the convex portion 15*a* in a direction (a direction which becomes a length direction of the plastic tape 4 at the time of welding) orthogonal to the convex portion arrangement direction is set to be the length of another side. Then, in the following, the ratio of the area of the convex portion for heating 15*a* to an area obtained by adding the area of the convex portion for heating 15*a* and the area of a single space between the convex portions, which is next to the convex portion for heating 15*a*, is referred to as a "convex portion area ratio". It is preferable that the heat block 15 have a tip surface of a rectangular shape and one side of the rectangle be parallel to the convex portion arrangement direction. Further, it is preferable that the heat block 15 be fabricated with the convex portion area ratio of the heat block 15 set to be in a range of 20% to 70%, and more preferably, a range of 30% to 50%. In the convex portion area ratio of less than 20%, it is not possible to apply a sufficient bundling force, and on the other hand, if the convex portion area exceeds 70%, stretching of the plastic tape becomes significant, thereby causing an obstacle to bundling.

The Two set guides 16 are disposed to be separated from each other in the width direction of the plastic tape 4 (the X direction). An upper portion of each set guide 16 is formed so as to have an L-shaped cross-section, and the respective set guides 16 are disposed on both sides of the slide placement section 25 (the front side and the back side in FIG. 6: in the drawing, only the set guide on the back side is shown) at a distance greater than or equal to the tape width such that portions extending in the horizontal direction of upper ends thereof face each other. The set guides 16 interlock and are made so as to approach each other or be separated from each other in such a manner that when the set guide 16 on one side moves in the +X direction, the set guide 16 on the other side moves in the −X direction, and with regard to the ±Z direction, the two move in the same direction.

Hereinafter, a bundling method using this apparatus will be described. In a case of performing bundling, first, the transport clamp 13 moves in the −Z direction and the −Y direction from a standby position shown in FIG. 6 and grips the leading end portion of the plastic tape 4 gripped by the delivery clamp 11 slightly protruding from there. Then, the delivery clamp 11 enters a state of releasing the plastic tape 4, and subsequently, the transport clamp 13 moves in the +Y direction, thereby drawing the plastic tape 4 from the tape supply roll 10. The transport clamp 13 ascends so as to exceed the slide set holder 14 on the way and then continues to move in the +Y direction. In this way, the drawn plastic tape 4 is put over the slide placement table 20 between the four slide holding frames 21 of the slide set holder 14.

If the transport clamp 13 advances to a predetermined position in the Y direction, the transport clamp 13 stops at the predetermined position. Subsequently, the delivery clamp 11 acting as a tape fixing unit enters a state of gripping and fixing the plastic tape 4 again and the transport clamp 13 moves by a predetermined distance in the −Y direction. In this way, the plastic tape 4 is placed on the slide placement table 20 in a sufficiently slack state.

Next, after the slide supply unit 17 in which a predetermined number (a plurality) of slides 2 are retained descends, the slide supply unit 17 stops at a position close to the upper ends of the four slide holding frames 21 and releases the retention of the plurality of slides 2 retained therein. Therefore, the slides 2 are placed on the slide placement table 20 with the plastic tape 4 interposed therebetween and stacked up inside the four slide holding frames 21 (in the slide placement section 25 shown in FIG. 6). The plurality of slides 2 stacked up in this way configure the laminated body 3 having a substantially rectangular parallelepiped shape as a whole (refer to FIG. 7).

Next, the two set guides 16 move in a direction approaching each other and stops at an interval of about the tape width. In this way, a horizontal portion of each upper end of the set guides 16 enters a state of being located above a side portion of the laminated body 3. Thereafter, the set guides 16 descend by a predetermined length together, whereby a state is created where each of the lower surfaces of the horizontal portion is nearly aligned with the upper surface of the holder side plate 22. In other words, the lower surfaces of the horizontal portions of the set guides 16 are located on the same plane as the upper surface of the holder side plate 22.

Figure 7:
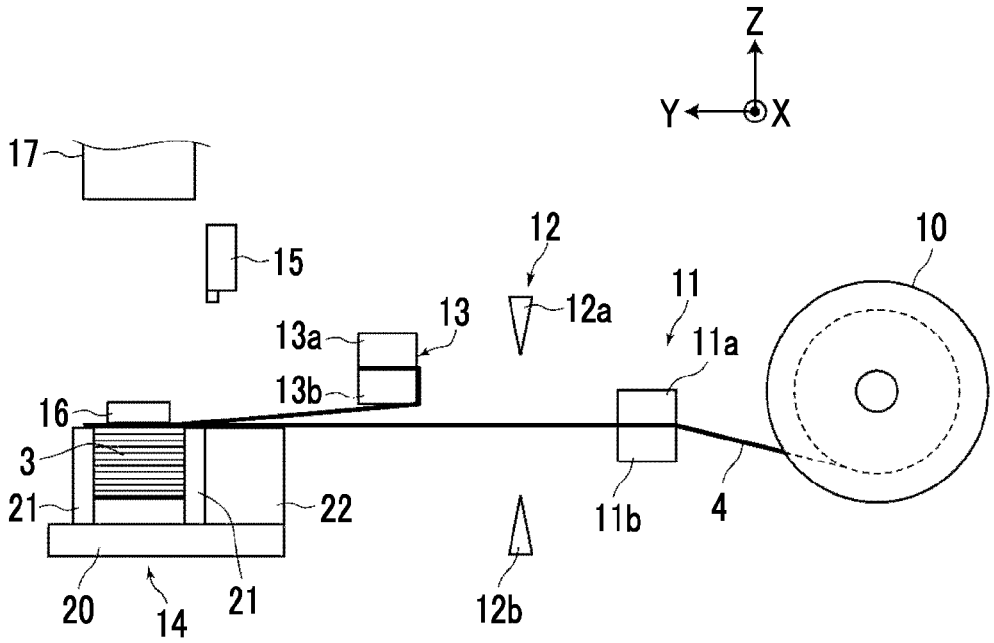
FIG. 7 is a schematic diagram showing a state at the time of bundling work of the bundling apparatus shown in FIG. 6.

Next, the transport clamp 13 moves by a predetermined distance in the −Y direction and enters a state where a portion of the plastic tape 4 winds around the laminated body 3 once, as shown in FIG. 7. In addition, at this time, since the two set guides 16 are spaced apart from each other at an interval of about the tape width, the plastic tape 4 can pass through between the horizontal portions of the pair of set guides 16. In this manner, when the transport clamp 13 moves, a force in the +Z direction and a force in the −Y direction are applied to the laminated body 3. However, the movement in the +Z direction of the laminated body 3 is taken by contact with the lower surfaces of the horizontal portions of the set guides 16 and the movement in the −Y direction is taken by the holder side plate 22 of the slide set holder 14, whereby the position of the laminated body 3 is defined. In this way, the upper end of the laminated body 3 and the upper surface of the holder side plate 22 are located on the same plane. At this time, the delivery clamp 11 can also be used as the tape fixing unit and can also be used as unit for applying the force in the −Y direction.

Figure 8:
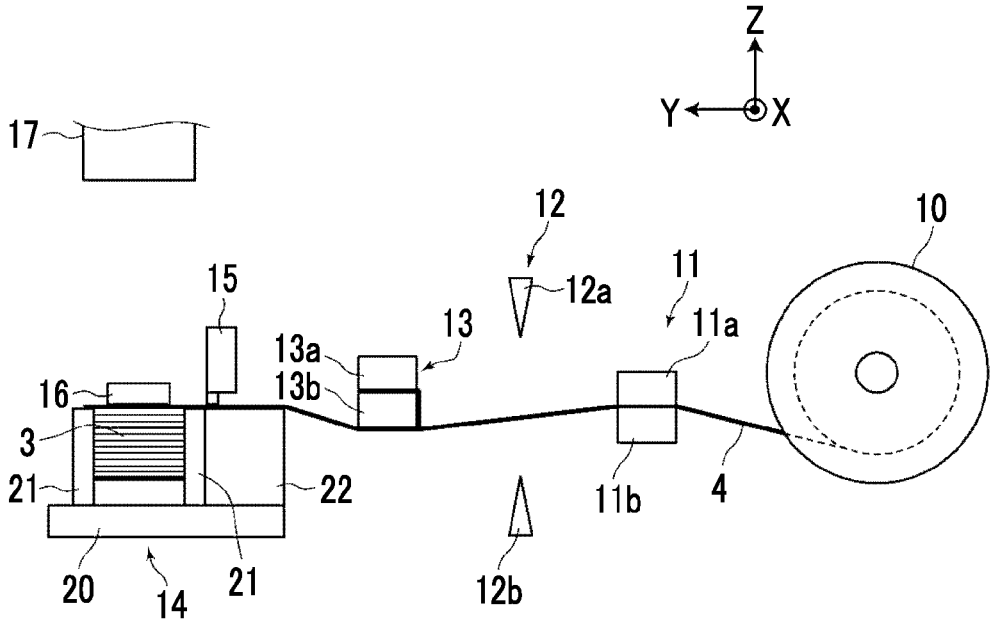
FIG. 8 is a schematic diagram showing another state at the time of bundling work of the bundling apparatus shown in FIG. 6.

Next, the transport clamp 13 descends by a predetermined distance, thereby entering a state shown in FIG. 8. The transport clamp 13 which has moved to this position acts as the tape tightening unit for applying a pulling force to the plastic tape 4. That is, when in such a state, the plastic tape 4 winds around the laminated body 3 in an elastically deformed and stretched state, whereby the plurality of slides 2 configuring the laminated body 3 are strongly tightened up with the plastic tape 4. It is preferable to fabricate the bundled object with the tensile stress of the plastic tape at the time of welding set to be in a range of 40% to 99%, and more preferably, a range of 50% to 80% of stress in which the tape starts plastic deformation. Further, at this time, two plastic tapes 4 are overlapped on the upper surface of the holder side plate 22.

Next, the heat block 15 descends from a standby position and the plurality of heated convex portions 15*a* thereof are pressed onto the two overlapped plastic tapes 4. At this time, the pressing positions of the plurality of convex portions 15*a* are positions out of the laminated body 3 near one marginal portion 3*a* (refer to FIG. 1) of the laminated body 3. Due to the above operation, the two plastic tapes 4 are welded to each other at pressing places of the convex portions 15*a*. In this way, the two superimposed plastic tapes 4 are welded at a position close to one marginal portion 3*a*, that is, at end portions on the laminated body 3 side of the superimposed portions. If the welding is completed, the heat block 15 ascends, thereby returning to the original standby position.

In addition, if the welded portions of the two superimposed plastic tapes 4 can be formed at a position close to one marginal portion 3*a*, it is not necessary to necessarily make the upper end of the laminated body 3 and the upper surface of the holder side plate 22 be located on the same plane.

Figure 9:
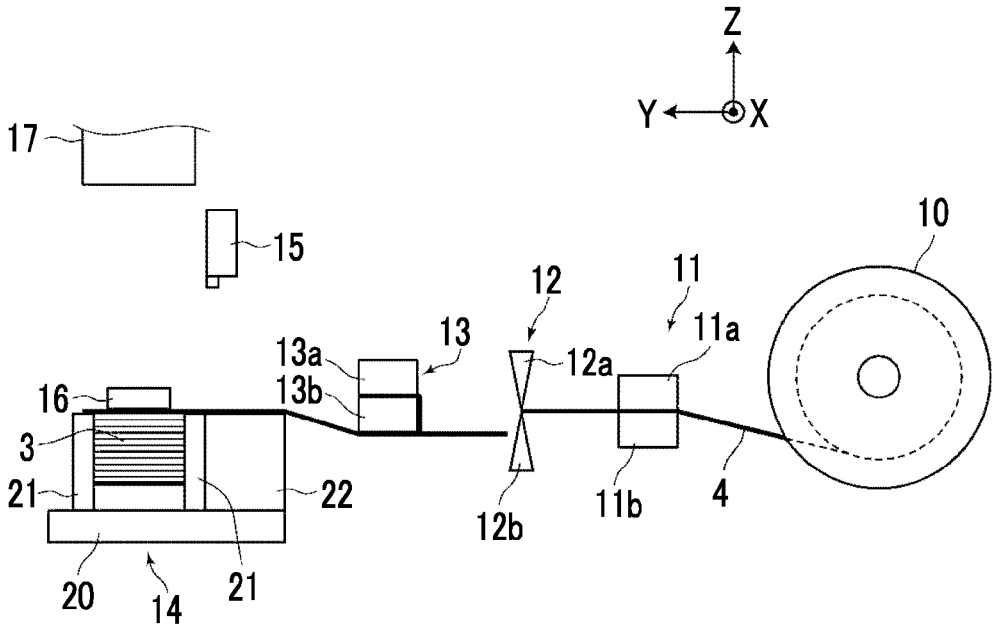
FIG. 9 is a schematic diagram showing still another state at the time of bundling work of the bundling apparatus shown in FIG. 6.

Next, the upper blade 12*a* and the lower blade 12*b* of the tape cutter 12 that is a tape cutting unit are operated, whereby the plastic tape 4 is cut at a place farther on the leading end side to some extent than a portion gripped by the delivery clamp 11. A state at this time is shown in FIG. 9. Thereafter, the gripping of the plastic tape 4 by the transport clamp 13 is released and a bundled object made by bundling the laminated body 3 with the plastic tape 4 is extracted from the slide set holder 14. The extraction of the bundled object may be performed by an automated device (not shown) or may be performed by the manual labor of a worker. By the above, the bundled object 1 as shown in FIG. 1 is obtained.

In the method described above, when moving the transport clamp 13 to the position shown in FIG. 7, the plurality of slides 2 being in a laminated state are moved by the movement of the plastic tape 4 which surround the plurality of slides 2, and one side surface thereof is received by the holder side plate 22 and the upper surface thereof is received by the horizontal portions of the pair of set guides 16, and thus a position is defined, and therefore, it is not necessary to separately provide a complicated positioning mechanism for aligning the end surfaces of the plurality of slides 2, thereby defining the end surfaces at a predetermined position.

Further, as can be seen from FIG. 7, insofar as being able to enter between the slide placement table 20 of the slide set holder 14 and the horizontal portions of the set guides 16, the number of slides 2 which are laminated can be arbitrarily set. Then, even if the number of slides 2 which are laminated is any number, it is possible to bundle the slides 2 by using the same plastic tape 4.

Further, since the welding of the plastic tape 4 winding around the laminated body 3 is performed on the holder side plate 22 out of the laminated body 3, it becomes possible to perform the welding without basically transferring heat for welding to the slides 2. Therefore, it is possible to prevent a situation where the slides 2 are damaged by heat.

Further, as described above with reference to FIG. 8, since the plastic tapes 4 can be welded to each other in a state of elastically deformed by applying a pulling force to the plastic tape 4 as it is, it becomes possible to bundle the plurality of slides 2 with a strong force with the plastic tape 4.

In addition, since the heat block 15 (refer to FIGS. 15A to 15D) provided with the plurality of convex portions 15*a* for heating disposed at intervals from each other is used for the welding of the plastic tape 4, the plastic tape 4 can be prevented from being stretched at the time of welding, as in a case of using a single heating portion extending over the entire width of the plastic tape 4. Therefore, also in this regard, it becomes possible to weld the plastic tapes 4 to each other in a state of elastically deforming the plastic tapes 4 as it is, and it becomes possible to bundle the plurality of slides 2 with a strong force with the plastic tape 4.

In addition, in the method described above, the welded portions G shown in FIG. 1 are not particularly formed. However, the welded portions G may be appropriately provided as necessary. For example, in the apparatus shown in FIG. 6, it is possible to weld the two plastic tapes 4 on the holder side plate 22 to each other by disposing another heat block being basically the same as the heat block 15 on the right side in the drawing of the heat block 15 and moving the another heat block down after the welding by the heat block 15 is performed or at approximately the same timing as the welding. On the other hand, if a mechanism to move the bundled object is provided, it is possible to perform welding even by the heat block 15. Further, the heat block 15 may be moved in the −Y direction.

Figure 10:
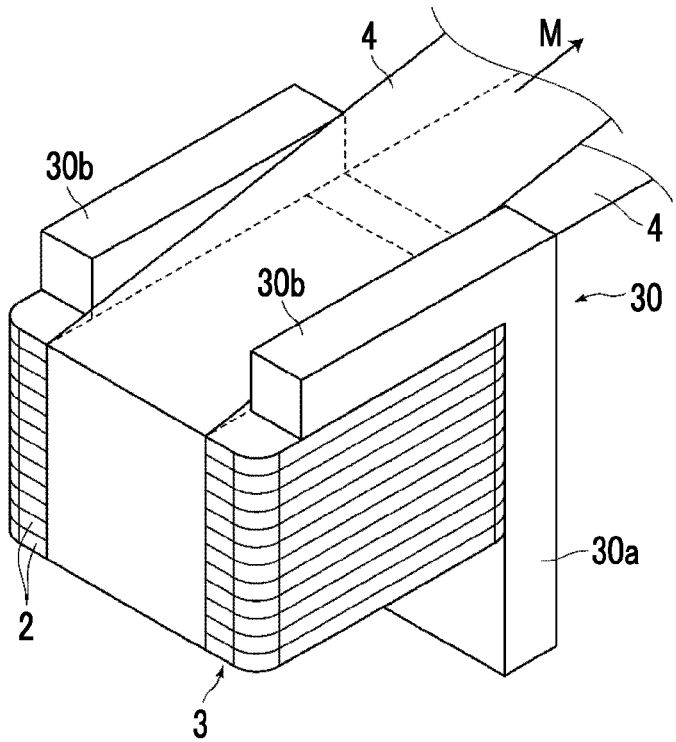
FIG. 10 is a perspective view showing an example of body-to-be-bundled retaining unit which is applied to the bundling apparatus according to the present invention.

Further, as means for defining the positions of the plurality of slides 2 laminated, in addition to the holder side plate 22 and the set guide 16 described above, it is also possible to use a single holder jig 30 having a shape as shown in FIG. 10. The holder jig 30 is configured to have a single side plate 30*a* extending in a vertical direction, and two arms 30*b* respectively extending in the length direction of the plastic tape 4 from both right and left side ends of an upper end of the side plate 30*a*. Also in a case of using the holder jig 30, by pulling the plastic tape 4 wound around the plurality of slides 2 in a direction of an arrow M, it is possible to position and retain the laminated body 3 composed of the plurality of slides 2 by making the side surface and the upper surface of the laminated body 3 respectively come into contact with the side plate 30*a* and the arms 30*b*.

Further, as the plastic tape 4, it is not limited to a tape made of high-density polyethylene described above, and besides, as long as it is a thermally weldable tape such as a tape made of normal polyethylene or a tape made of polypropylene, for example, a tape made of any plastic is also basically applicable.

Figure 11A:
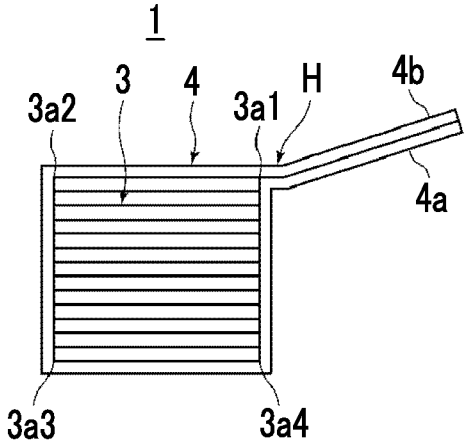
FIGS. 11A and 11B is a diagram describing the cutting of a plastic tape in the bundled object according to the present invention.

Here, the plastic tape 4 being able to be particularly easily cut in the bundled object 1 according to the present invention will be described with reference to FIGS. 11A and 11B. As a premise, it is assumed that the laminated body 3 as a body-to-be-bundled is put in the holder 5 (not shown) as shown in FIG. 2. FIG. 11A shows a state where both end portions 4*a* and 4*b* as the pull tape portions of the plastic tape 4 have not been pulled. Here, the four marginal portions 3*a* of the laminated body 3 are distinctively shown as 3*a*1, 3*a*2, 3*a*3, and 3*a*4, as shown in the drawing. The plastic tapes 4 have been welded to each other near one marginal portion 3*a*1 among the marginal portions.

The fact that even if from this state, both end portions 4*a* and 4*b* are pulled in a direction as shown in FIG. 3 or 4 above, the plastic tape 4 can be cut near the marginal portion 3*a*1 of the laminated body 3 is as described above. However, unlike this case, if both end portions 4*a* and 4*b* are pulled in a direction of an arrow P shown in FIG. 11B, cutting becomes particularly easy. That is, in a case of doing so, the marginal portion 3*a*1 of the laminated body 3 bites the plastic tape 4 and then, a portion between the biting portion and the welded portions H (refer to FIG. 2) is very short, and thus the plastic tape 4 of this portion is not greatly stretched by the pulling force. Therefore, the pulling force hardly acts so as to stretch the plastic tape 4 and the force efficiently acts in order to cut the plastic tape 4 at the welded portions H and the non-welded portions adjacent thereto. Therefore, even if the pulling force is relatively small, the plastic tape 4 is more reliably and easily cut.

Figure 12A:
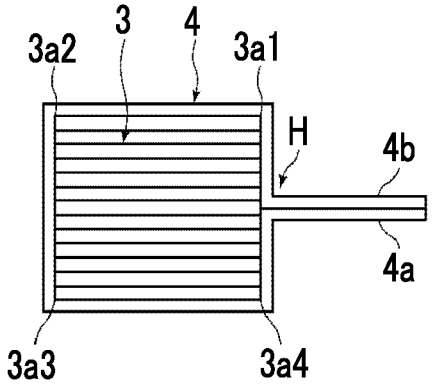
FIGS. 12A and 12B is a diagram describing the cutting of a plastic tape in a bundled object in an art other than the present invention.
Figure 12B:
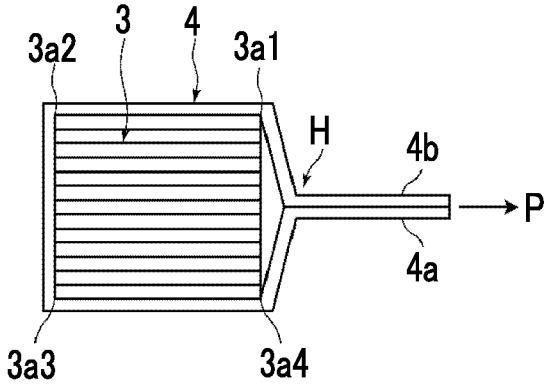

In contrast, FIGS. 12A and 12B shows a bundled object in which the plastic tapes 4 are welded to each other on the lateral side of the side surface of the laminated body 3, unlike the bundled object according to the present invention. In such a bundled object, a case where the plastic tape 4 is cut will be described. First, it is assumed that both end portions 4*a* and 4*b* of the plastic tape 4 are pulled in a direction of an arrow P of FIG. 12B from the bundled state shown in FIG. 12A. Also during this state, the marginal portions 3*a*1 and 3*a*4 of the laminated body 3 bite the plastic tape 4 to some extent. However, since a portion between the biting portion and the welded portions H is significantly longer than in the case of the bundled object according to the present invention described above, the pulling force also acts so as to stretch the plastic tape 4 of this portion. Therefore, compared to the case of the bundled object according to the present invention, if the pulling force is not further increased, it becomes difficult to cut the plastic tape 4.

Further, the extent that the marginal portions 3*a*1 and 3*a*4 of the laminated body 3 bite the plastic tape 4 also becomes smaller than in the case of the bundled object according to the present invention described above. For this reason, a force to pull both end portions 4*a* and 4*b* of the plastic tape 4 is prone to act so as to stretch the plastic tape 4 between the marginal portions 3*a*1 and 3*a*2 and likewise between the marginal portions 3*a*3 and 3*a*4. Accordingly, also in this regard, it is necessary to further increase the pulling force in order to cut the plastic tape 4.

Figure 11B:
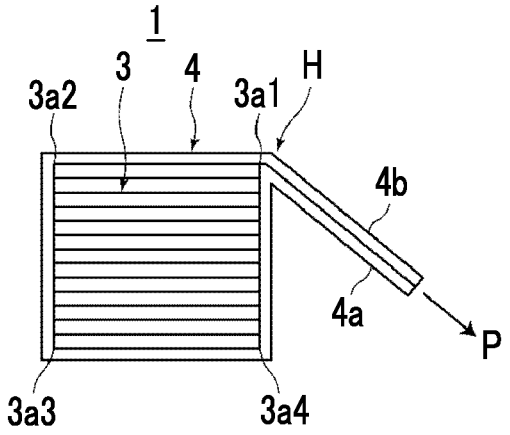

In addition, it is also possible to pull both end portions 4*a* and 4*b* of the plastic tape 4 in the same direction as the direction of the arrow P of FIG. 11B from the bundled state shown in FIG. 12A. In such a case, the extent that the marginal portion 3*a*1 of the laminated body 3 bites the plastic tape 4 becomes close to that in the case of FIG. 11B. However, even in the case, a portion between the marginal portion 3*a*1 and the welded portions H is easily stretched, and thus it is still difficult for the pulling force to be effectively used for the cutting of the plastic tape 4.

Example

Preferable Range of Bundling Force

Next, a preferable range of a force to bundle the laminated body 3 will be described. Here, with respect to the tensile strength of the plastic tape 4, what extent is preferable to be selected as a bundling force of a ratio was determined by experiment. In addition, the "tensile strength" of the plastic tape 4 which is dealt with here is defined by the lowest tensile stress in which the elasticity thereof is lost, that is, stress in which the plastic tape 4 starts plastic deformation if the plastic tape 4 is pulled with a further force. The reason for focusing on the elasticity of the plastic tape 4 is because, in order to strongly bundle the laminated body 3 composed of a plurality of articles laminated, it becomes essential to elastically bundle the laminated body 3 with the tape 4.

a. Test Conditions

In the experiment, the bundling strength was evaluated with the bundled object 1 as a target, in which the laminated body 3 made by overlapping twelve of the above-described slides for biochemical analysis was bundled with the plastic tape 4. A material of a portion to be bundled of the slide for biochemical analysis is thermoplastic resin, and the weight thereof is 10 g and the size is 28 mm lengthwise×24 mm crosswise×22 mm thick. On the other hand, as the plastic tape 4, tapes were obtained by cutting high-density polyethylene (HDPE) tapes having thicknesses of 20 μm and 30 μm to respectively have widths of 15 mm.

Figure 13:
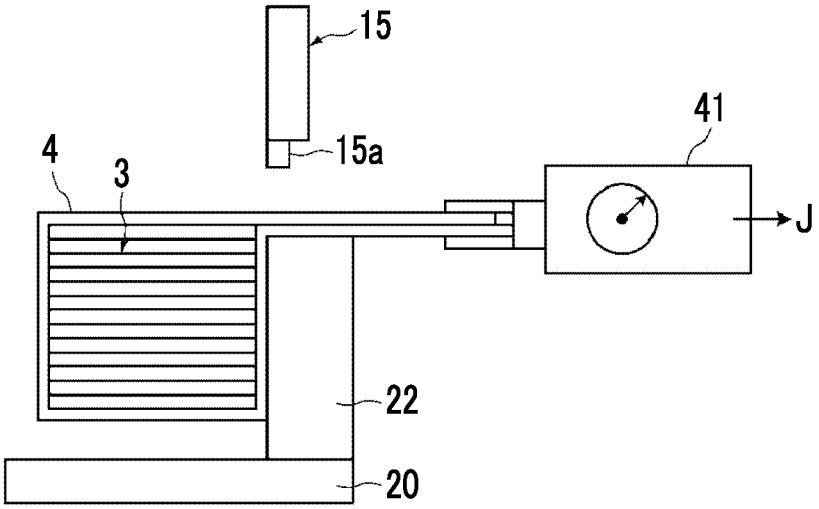
FIG. 13 is a schematic diagram showing a device for an experiment to determine a preferable bundling force.

The laminated body 3 made by overlapping the twelve slides was wound with the plastic tape 4 in a slide lateral direction and a thickness direction and the plastic tapes 4 were welded to each other in a state where tension (tensile stress) was applied thereto. A state at this time is schematically shown in FIG. 13. As shown in the drawing, the slide placement table 20 and the holder side plate 22 being basically the same as those shown in FIG. 6 above were used, both ends of the plastic tape 4 were fixed to a force gauge (a pulling force measuring instrument) 41, and the two plastic tapes 4 were welded to each other by the heat block 15 while confirming that predetermined tensile stress acts on the plastic tape 4 by pulling the force gauge 41 in a direction of an arrow J, by the force gauge 41. The predetermined tensile stress was set to three percentages, 10%, 50%, and 80% of the tensile strength described above. Further, as the heat block 15, a heat block was used in which the ratio of the area of the comb tooth-like convex portion for heating 15*a* (refer to FIGS. 15A to 15D) having a rectangular tip surface to the total area of the convex portion for heating 15*a* and the space between the convex portion for heating 15*a* and a single convex portion adjacent thereto (the space which is located between the two convex portions for heating 15*a* adjacent to each other at a distance), that is, the convex portion area ratio was 50% (that is, the area ratio between the convex portion 15*a* and the space between the convex portions was 1:1), and a setting temperature was set to be 170° C. and a welding time was set to be 1.5 seconds.

b. Evaluation Methods

Evaluation was performed by the following two methods.

Evaluation Method 1

Figure 14:
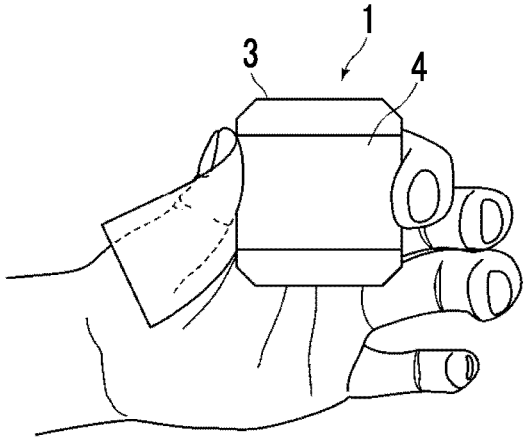
FIG. 14 is a schematic diagram showing a process of the experiment to determine a preferable bundling force.
Figure 15A:
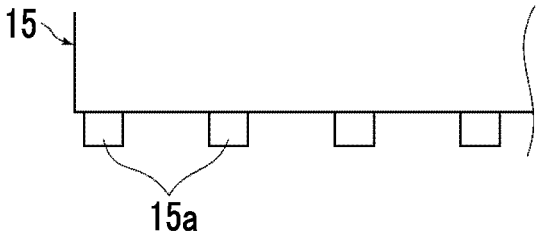
FIGS. 15A to 15D is a schematic diagram showing examples of the shape of a heat block configuring the bundling apparatus according to the present invention.
Figure 15B:
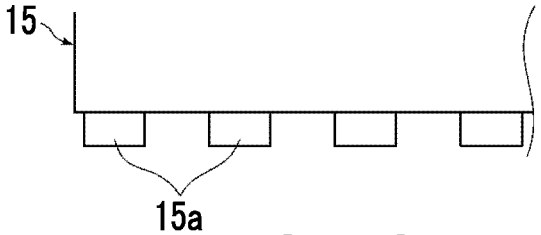
Figure 15C:
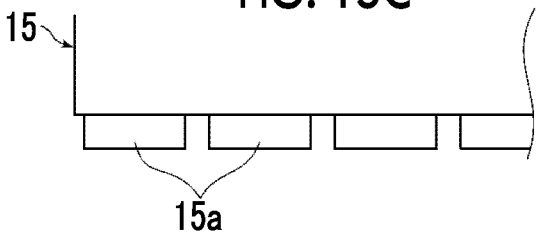
Figure 15D:
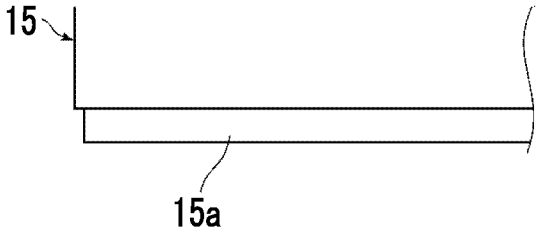

The bundled object 1 immediately after the bundling was lightly gripped by making the thumb and the index finger rest on the portion of the plastic tape 4, as shown in FIG. 14, and in this state, whether or not the slides configuring the laminated body 3 fall out was confirmed.

Evaluation Method 2

The bundled object 1 was dropped onto a flat table from a height of 200 mm, and thereafter, the bundled object 1 was lightly gripped similar to Evaluation Method 1 described above, and then whether or not the slides fall out was confirmed.

c. Evaluation Results

The evaluation results by the two evaluation methods described above are shown in Tables 1 and 2 below.

TABLE 1

| Case of Tape Thickness of 20 μm | | | |
|---|---|---|---|
| | Ratio of tensile stress to tensile strength | | |
| | 10% | 50% | 80% |
| Evaluation Method 1 | No slide falling-out | No slide falling-out | No slide falling-out |
| Evaluation Method 2 | Slide has fallen | No slide falling-out | No slide falling-out |

TABLE 2

| Case of Tape Thickness of 30 μm | | | |
|---|---|---|---|
| | Ratio of tensile stress to tensile strength | | |
| | 10% | 50% | 80% |
| Evaluation Method 1 | No slide falling-out | No slide falling-out | No slide falling-out |
| Evaluation Method 2 | Slide has fallen | No slide falling-out | No slide falling-out |

As shown in Tables 1 and 2, in the bundled object 1 fabricated with a plastic tape tensile stress force at the time of welding set to be 10% of stress in which the tape starts plastic deformation, it was found that if the bundled object 1 was dropped, the plastic tape was loosened, and thus the bundling was easily released. In contrast, in the bundled objects 1 fabricated with a plastic tape tensile stress at the time of welding set to be 50% and 80% of stress in which the tape starts plastic deformation, it was confirmed that even if the bundled objects 1 were dropped, the bundling was not released.

From the above results, it can be said that in a case where the plastic tapes are welded to each other by the heat block 15 having the comb tooth-like convex portions 15*a* as shown in FIGS. 15A to 15D, it is preferable that the bundled object according to the present invention be fabricated with a plastic tape tensile stress at the time of welding set to be in a range of 50% to 80% of stress in which the tape starts plastic deformation.

<<Preferable Range of Convex Portion Area Ratio>>

In a case where the plastic tapes are welded to each other by the heat block 15 having the comb tooth-like convex portions 15*a* as described above, bundling strength also depends on the convex portion area ratio described above. The results of the experiment of investigating in detail a preferable range of the convex portion area will be described below.

a. Test Conditions

The bundling strength was evaluated with the bundled object 1 as a target in which the laminated body 3 made by overlapping twelve of the same slides for biochemical analysis as that used in the above-described experiment was bundled with the plastic tape 4. As the plastic tape 4, a tape obtained by cutting a high-density polyethylene (HDPE) tape having thicknesses of 20 μm to have a width of 15 mm was used.

The laminated body 3 made by overlapping the twelve slides was wound with the plastic tape 4 in a slide lateral direction and a thickness direction and the plastic tapes 4 were welded to each other in a state where tension (tensile stress) was applied thereto by using the device shown in FIG. 13. At this time, the above-described tensile stress was uniformly set to be 50% of stress in which the plastic tape starts plastic deformation.

Usually, the tip surface of the convex portion for heating 15*a*, that is, the surface which comes into contact with the plastic tape 4 has an approximately rectangular shape (includes a square shape), one side of which is parallel to the width direction of the plastic tape 4, and also in this experiment, the heat block 15 having the convex portions for heating 15*a* of such a shape was used. Then, in this experiment, the heat blocks 15 of types A, B, C, and D having shapes shown approximately in FIGS. 15A to 15D were fabricated and the bundling strengths of the bundled object when using these heat blocks were respectively obtained. Here, the convex portion area ratios in the respective types are 30%, 50%, 80%, and 100% in the order of the types A, B, C, and D. In detail the type D is described as a type in which the convex portion 15*a* has no space and is formed in a single rectangular parallelepiped shape extending over the entire width of the plastic tape.

More specifically, the lengths in the plastic tape width direction of the convex portions 15*a* in the heat blocks 15 of the types A, B, C, and D are 0.9 mm, 1.5 mm, 2.4 mm, and 15 mm, respectively. Then, the length of the convex portion 15*a* in a direction orthogonal to the plastic tape width direction is 1.5 mm which is common to all the types. Further, the setting temperature of the heat block 15 was set to be six temperatures, 160° C., 165° C., 170° C., 175° C., 180° C., and 185° C. and welding time was set to be 1.5 seconds.

b. Evaluation Method

The evaluation was performed by Evaluation Method 2 described above. That is, the bundled object 1 was dropped onto a flat table from a height of 200 mm, then, the bundled object 1 was lightly gripped by making the thumb and the index finger rest on the portion of the plastic tape 4, as shown in FIG. 14, and in this state, whether or not the slides configuring the laminated body 3 fall out was confirmed.

c. Evaluation Results

The evaluation results are shown in Table 3 below.

TABLE 3

| | Type A (Convex portion area ratio: 30%) | Type B (Convex portion area ratio: 50%) | Type C (Convex portion area ratio: 80%) | Type D (Convex portion area ratio: 100%) |
|---|---|---|---|---|
| 160° C. | No slide falling-out | No slide falling-out | No slide falling-out | Bundling being impossible due to tape stretching |
| 165° C. | No slide falling-out | No slide falling-out | Slide has fallen | Bundling being impossible due to tape stretching |
| 170° C. | No slide falling-out | No slide falling-out | Slide has fallen | Bundling being impossible due to tape stretching |
| 175° C. | No slide falling-out | No slide falling-out | Slide has fallen | Bundling being impossible due to tape stretching |
| 180° C. | No slide falling-out | No slide falling-out | Slide has fallen | Bundling being impossible due to tape stretching |
| 185° C. | Slide has fallen | Slide has fallen | Slide has fallen | Bundling being impossible due to tape stretching |

As shown in Table 3, in order to secure a sufficient bundling force, it is preferable to set the convex portion area ratio of the heat block 15 to be 30% and 50%, and if the convex portion area ratio is set to be 80%, when the bundled object 1 is dropped, the bundling is easily released, and if the convex portion area ratio is set to be 100%, the bundling itself becomes impossible.

From the above results, it can be said that in a case where the plastic tapes are welded to each other by using the heat block 15 having the comb tooth-like convex portions 15*a* as shown in FIGS. 15A to 15D, it is preferable that the bundled object according to the present invention be fabricated with the convex portion area ratio of the heat block 15 set to be in a range of 30% to 50%.

In addition, the convex portion area ratio of the heat block 15 as described above basically directly becomes the ratio of the welded portion in the bundled object fabricated by using the heat block 15 to the total area of the welded portion and the non-welded portion between the welded portions. Therefore, the shape of the welded portion becomes a rectangular shape, one side of which is parallel to the width direction of the plastic tape, similar to the shape of the tip surface of the convex portion of the heat block 15. Further, the area of the non-welded portion refers to the area of a rectangular portion which is present between the two welded portions and in which a dimension thereof in the length direction of the plastic tape is set to be the same as that of the welded portion.

Here, the reason that bundling becomes impossible in the heat block 15 of the type D described above, will be described. In a case where the laminated body 3 is bundled with the plastic tape 4 by using the device as shown in FIG. 13 or the apparatus as shown in FIG. 6, tensile stress is applied to the plastic tape 4, and thus the tape 4 is in a state of being tightened due to a spring effect by its own elastic deformation. However, if welding is performed by the heat block 15 of the type D in this state, stretching of the plastic tape 4 occurs in the vicinity of the welded portion. As a result, a bundling length of the plastic tape 4 increases, and thus it is considered that stretching of elastic deformation is cancelled out, whereby a bundling force disappears.

In contrast, the heat blocks 15 of the types A, B, and C can prevent the stretching of the welded portion described above. In the plastic tapes 4 welded by the heat blocks 15, a plurality of welded portions H are arranged at intervals (the non-welded portions) from each other in the tape width direction, as shown in FIG. 1. In the welded portion H, the stretching of the plastic tape 4 occurs. However, in the non-welded portion, such stretching does not occur basically, and therefore, a bundling length of the entire tape does not change and a bundling force is maintained.

In addition, strictly speaking, also in cases of using the heat blocks 15 of the types A, B, and C, in the non-welded portion of the plastic tape 4, some stretching sometimes occurs under a thermal effect of the welded portion H adjacent thereto. The heat block 15 of particularly the type C among these performs welding with the ratio of the non-welded portion to the welded portion H being smaller, compared to the heat blocks 15 of the types A and B. Therefore, in a case of using the heat block 15 of the type C, stretching becomes significant as the width of the non-welded portion is smaller, and thus, although it is not so much that the body-to-be-bundled falls out, but the bundling force becomes weaker. Therefore, if a dropping test as in Evaluation Method 2 described above, or the like is performed, stretching easily occurs in the plastic tape 4, thereby resulting in no dropping-resistance.

What is claimed is:

1. A bundled object comprising:

a body-to-be-bundled which is made by overlapping a plurality of articles and has four marginal portions each extending in a direction orthogonal to an overlapping direction; and a strip-shaped plastic tape which bundles the body-to-be-bundled by winding around the body-to-be-bundled once so as to pass over the four marginal portions, wherein the bundled object has superimposed portions in which both ends of the plastic tape are overlapped on each other from a position of one marginal portion among the four marginal portions in a state of being away from the body-to-be-bundled, and the superimposed portions are welded to each other at a plurality of places arranged at intervals from each other in a tape width direction, at end portions on the body-to-be-bundled side.

2. The bundled object according to claim 1, wherein the shape of one welded portion of the plastic tape is a rectangular shape, one side of which is parallel to a width direction of the plastic tape, and a ratio of an area of the welded portion to the total area of the welded portion and a non-welded portion which is located between two welded portions is in a range of 20% to 70%.

3. The bundled object according to claim 2, wherein the ratio is in a range of 30% to 50%.

4. The bundled object according to claim 1, wherein the plastic tape is a tape made of at least one of polyethylene and polypropylene.

5. A bundling method for manufacturing a bundled object, said bundled object comprising a body-to-be-bundled which is made by overlapping a plurality of articles and has four marginal portions each extending in a direction orthogonal to an overlapping direction, and a strip-shaped plastic tape which bundles the body-to-be-bundled by winding around the body-to-be-bundled once so as to pass over the four marginal portions, said method comprising:

storing the plastic tape, which has been elongated, in a storage unit;

drawing a leading end of the plastic tape in a longitudinal direction;

putting the drawn plastic tape over a side plate having a flat upper surface, and an article placement table;

stacking up and placing a plurality of articles on the article placement table with the plastic tape put over the article placement table interposed therebetween, thereby forming the body-to-be-bundled;

moving the plastic tape on the leading end side so as to be separated upward from the article placement table and be returned farther to the storage unit side than the side plate, thereby bringing an upper end of the body-to-be-bundled moving upward, into contact with up-and-down position defining unit, and also bringing a side surface of the body-to-be-bundled moving to the storage unit side, into contact with the side plate;

making a force to tighten the body-to-be-bundled act on the plastic tape;

welding two plastic tapes to each other on the upper surface of the side plate in a state where the force acts on the plastic tape and the two plastic tapes are placed on the upper surface; and thereafter, cutting the plastic tape between a portion in which the welding is made and the storage unit, wherein the bundled object has superimposed portions in which both ends of the plastic tape are overlapped on each other from a position of one marginal portion among the four marginal portions in a state of being away from the body-to-be-bundled, and wherein the superimposed portions are welded to each other at a plurality of places arranged at intervals from each other in a tape width direction, at end portions on the body-to-be-bundled side.

6. The bundling method according to claim 5, wherein in the step of drawing a leading end of the plastic tape in a longitudinal direction, the plastic tape is drawn in the longitudinal direction with one end as a leading end in a drawing direction, in the step of putting the drawn plastic tape over a side plate having a flat upper surface, and an article placement table, the article placement table is located on the side opposite to the storage unit with respect to the side plate and is at a position lower than the upper surface, in the step of stacking up and placing a plurality of articles on the article placement table with the plastic tape put over the article placement table interposed therebetween, thereby forming a body-to-be-bundled composed of the plurality of articles, the plurality of articles are placed on the article placement table with a portion farther on the storage unit side than the leading end of the plastic tape interposed therebetween, in the step of moving the plastic tape on the leading end side so as to be separated upward from the article placement table and be returned farther to the storage unit side than the side plate, the plastic tape is fixed farther on the storage unit side than a place on which the body-to-be-bundled is placed, and in the step of moving the plastic tape on the leading end side so as to be separated upward from the article placement table and be returned farther to the storage unit side than the side plate, the plastic tape farther on the leading end side than the place on which the body-to-be-bundled is placed is moved so as to be separated upward from the article placement table and be returned farther to the storage unit side than the side plate.

7. The bundling method according to claim 5, wherein tensile stress having a magnitude in a range of 40% to 99% of stress in which the plastic tape starts plastic deformation is made to act on the plastic tape in order to tighten the body-to-be-bundled.

8. The bundling method according to claim 7, wherein tensile stress having a magnitude in a range of 50% to 80% of stress in which the plastic tape starts plastic deformation is made to act on the plastic tape in order to tighten the body-to-be-bundled.

9. The bundling method according to claim 5, wherein the welding is performed by using a heat block in which convex portions for heating in which a tip surface coming into contact with the plastic tape has a rectangular shape and one side of the rectangular shape is set to be parallel to a width direction of the plastic tape are disposed in a plurality at intervals from each other in the width direction of the plastic tape.

10. The bundling method according to claim 9, wherein an area ratio of the convex portion for heating against the total area of the convex portion for heating, and one space between the convex portions for heating wherein the space is adjacent to the convex portion for heating, is in a range of 20% to 70%.

11. The bundling method according to claim 10, wherein a heat block in which the area ratio is in a range of 30% to 50% is used.

12. A bundling apparatus for manufacturing a bundled object, said bundled object comprising a body-to-be-bundled which is made by overlapping a plurality of articles and has four marginal portions each extending in a direction orthogonal to an overlapping direction, and a strip-shaped plastic tape which bundles the body-to-be-bundled by winding around the body-to-be-bundled once so as to pass over the four marginal portions, wherein the apparatus comprises:

a storage unit for storing the plastic tape, which has been elongated;

a tape drawing unit for drawing a leading end of the plastic tape in a longitudinal direction;

an article set holder having a side plate having a flat upper surface, and an article placement table which is located on the side opposite to the storage unit with respect to the side plate;

a tape putting-over unit for putting the drawn plastic tape over the upper surface of the side plate and the article placement table;

a body-to-be-bundled supply unit for stacking up and placing a plurality of articles on the article placement table, thereby forming the body-to-be-bundled;

an up-and-down position defining unit disposed above the body-to-be-bundled formed on the article placement table, at a distance from the body-to-be-bundled;

a tape moving unit for moving the plastic tape on the leading end side so as to be separated upward from the article placement table and be returned farther to the storage unit side than the side plate, thereby bringing an upper end of the body-to-be-bundled into contact with the up-and-down position defining unit and also bringing a side surface of the body-to-be-bundled into contact with the side plate;

a tape tightening unit for making a force to tighten the body-to-be-bundled act on the plastic tape;

a welding unit for welding two plastic tapes to each other on the upper surface of the side plate in a state where the force acts on the plastic tape and the two plastic tapes are placed on the upper surface; and a tape cutting unit for cutting the plastic tape between a portion in which the welding is made and the storage unit, wherein the bundled object has superimposed portions in which both ends of the plastic tape are overlapped on each other from a position of one marginal portion among the four marginal portions in a state of being away from the body-to-be-bundled, and wherein the superimposed portions are welded to each other at a plurality of places arranged at intervals from each other in a tape width direction, at end portions on the body-to-be-bundled side.

13. The bundling apparatus according to claim 12, further comprising:

a tape fixing unit for fixing the plastic tape farther on the storage unit side than a place on which the body-to-be-bundled is placed, wherein the tape drawing unit draws the plastic tape in the longitudinal direction with one end of the plastic tape as a leading end in a drawing direction, the article placement table is at a position lower than the upper surface of the side plate, the body-to-be-bundled supply unit stacks up and places a plurality of articles on the article placement table with a portion farther on the storage unit side than the leading end of the plastic tape interposed therebetween, and the tape moving unit moves the plastic tape farther on the leading end side than the place on which the body-to-be-bundled is placed, so as to be separated upward from the article placement table and be returned farther to the storage unit side than the side plate, thereby bringing an upper end of the body-to-be-bundled moving upward, into contact with the up-and-down position defining unit, and also bringing a side surface of the body-to-be-bundled moving to the storage unit side, into contact with the side plate.

14. The bundling apparatus according to claim 12, wherein the tape tightening unit makes tensile stress act on the plastic tape in order to tighten the body-to-be-bundled, and the stress is set to be in a range of 40% to 99% of stress in which the plastic tape starts plastic deformation.

15. The bundling apparatus according to claim 14, wherein the stress is set to be in a range of 50% to 80% of stress in which the plastic tape starts plastic deformation.

16. The bundling apparatus according to claim 12, wherein the welding unit is a heat block in which convex portions for heating in which a tip surface coming into contact with the plastic tape has a rectangular shape and one side of the rectangular shape is parallel to a width direction of the plastic tape are disposed in a plurality at intervals from each other in the width direction of the plastic tape.

17. The bundling apparatus according to claim 16, wherein an area ratio of the convex portion for heating against the total area of the convex portion for heating, and one space between the convex portions for heating wherein the space is adjacent to the convex portion for heating, is in a range of 20% to 70%.

18. The bundling apparatus according to claim 17, wherein the area ratio is in a range of 30% to 50%.

19. The bundling apparatus according to claim 12, wherein the up-and-down position defining unit has a lower surface which comes into contact with the body-to-be-bundled, and when the tape moving unit brings the upper end of the body-to-be-bundled into contact with the up-and-down position defining unit, the lower surface of the up-and-down position defining unit is located on the same plane as the upper surface of the side plate.

20. The bundling method according to claim 5, wherein in a step of bringing an upper end of the body-to-be-bundled moving upward, into contact with the up-and-down position defining unit, the upper end of the body-to-be-bundled is brought into contact with the up-and-down position defining unit at a position on the same plane as the upper surface of the side plate.

21. The bundled object according to claim 1, wherein a magnitude of a stress applied to the strip-shaped plastic tape in order to tighten the body-to-be-bundled is set to be in a range of from 40% to 99% of a stress in which the strip-shaped plastic tape starts plastic deformation.

22. The bundled object according to claim 1, wherein a magnitude of a stress applied to the strip-shaped plastic tape in order to tighten the body-to-be-bundled is set to be in a range of from 50% to 80% of a stress in which the strip-shaped plastic tape starts plastic deformation.

* * * * *